United States Patent [19]

Bulfer

[11] Patent Number: 4,757,628

[45] Date of Patent: Jul. 19, 1988

[54] SHARK SABER

[76] Inventor: Gary M. Bulfer, 5715-13 Baltimore Dr., La Mesa, Calif. 92041

[21] Appl. No.: 31,021

[22] Filed: Mar. 27, 1987

[51] Int. Cl.[4] ..... F41C 9/06

[52] U.S. Cl. ..... 42/1.14; 42/70.01

[58] Field of Search ..... 42/1.14, 1.09, 1.12, 42/70.01; 17/1 B

[56] References Cited

U.S. PATENT DOCUMENTS

| | | | |
|---|---|---|---|
| Re. 17,571 | 1/1930 | Sedgley | 42/1.09 |
| 1,897,992 | 2/1933 | Ailes | 42/1.09 |
| 3,145,494 | 8/1964 | Willcox et al. | 42/1.14 |
| 3,235,992 | 2/1966 | Busillo | 42/1.09 |
| 3,553,876 | 1/1971 | Engler | 42/1.14 |
| 3,618,244 | 11/1971 | Johnson | 42/1.14 |
| 3,838,532 | 10/1974 | Prodanovich | 42/1.14 |
| 4,546,563 | 10/1985 | Amburn | 42/1.14 |
| 4,625,442 | 12/1986 | Hill et al. | 42/1.12 |

FOREIGN PATENT DOCUMENTS

| | | | |
|---|---|---|---|
| 2308896 | 11/1976 | France | 42/1.14 |
| 72365 | 8/1931 | Sweden | 42/1.12 |
| 27923 | 4/1903 | Switzerland | 42/1.12 |
| 85221 | 6/1920 | Switzerland | 42/1.12 |

*Primary Examiner*—Deborah L. Kyle
*Assistant Examiner*—Michael J. Carone
*Attorney, Agent, or Firm*—Harry M. Weiss & Associates

[57] ABSTRACT

A trigger fired underwater firearm particularly adapted to defense against sharks is described. The firearm has an elongated tubular handle with a cartridge receiving head at one end, a trigger mechanism in the middle, and a safety mechanism at the other end. A longitudinal shaft extends down the tube and has a firing pin at the end which engages the firing head and a safety pin where the shaft passes through the safety mechanism to the external cocking grip. Pulling back on the cocking grip on the end of the shaft stores energy in a firing spring. The firing mechanism uses a cocking notch in the interior elongated shaft to engage a moveable pawl on the end of a firing lever extending through the tube wall. Depressing the external end of the firing lever releases the pawl from the firing notch allowing the shaft carrying the firing pin to advance under spring pressure to hit the firing pin against the cartridge primer in the head end. The cartridge fires through the open end of the head into the target.

20 Claims, 1 Drawing Sheet

SHARK SABER

FIELD OF THE INVENTION

This invention relates to an apparatus for fishing or for protection against underwater attack by sharks or other large and dangerous sea creatures, and in particular to a firearm which may be easily armed, aimed, and discharged under water.

BACKGROUND OF THE INVENTION

Underwater firearms for fishing or for protection from large sea creatures are well known and take many forms. Various examples are described in U.S. Pat. Nos. 3,618,244; 3,664,052; 3,721,031; 3,747,247; 3,838,532; 3,871,120; and 4,100,692. They all have in common the fact that a gun powder charge held in a substantially conventional cartridge or shell is employed as the source of explosive. The cartridge is fired by bringing its primer in contact with a pin.

Many of these prior art devices are triggerless, that is, they fire automatically on impact with the target. The act of striking the target forces the firing pin against the cartridge primer or vice versa. Various sliding weights, springs, and inertial latches have been used on some versions to improve performance. For safety reasons they are constructed to require a solid hit against the target before they fire.

While some of these triggerless units are very simple in construction, they offer only limited protection or fishing opportunity to the user. The fact that they must hit the target before they will fire is a significant restriction and may expose the user to dangerous situations under circumstances where the target fish or the threatening shark does not present a clear chance for a solid hit until it actually attacks the user.

To overcome this problem, some prior art units are trigger fired, much as in a conventional firearm. They do not depend upon inertial forces resulting from contact with the target. These units have a firing pin which is cocked against a compressed spring. When the trigger is pulled, the compressed spring drives the firing pin into the cartridge primer. Such a unit is described, for example, in U.S. Pat. No. 3,618,244 where the exploding cartridge is used to propel a tethered spear head. A significant limitation of prior art triggered units is their complexity, limited safety features, poor reliability, and high cost. Thus, a need continues to exist for improved underwater firearms for fishing or defense against predatory sea creatures.

Accordingly, it is an object of the present invention to provide an improved underwater firearm of simple construction which is easy to operate, has a positive safety, is reliable in operation and simple to maintain, and which has a minimum of moving parts.

It is a further object of the present invention to provide an improved trigger fired underwater firearm which does not require contact with the target to fire.

It is an additional object of the present invention to provide an improved trigger fired underwater firearm which is particularly adapted to kill sharks.

It is a further object of the present invention to provide an improved underwater firearm which has a shape easily manipulated and aimed underwater and which has sharp points protruding around the muzzle for engaging the surface of the target so as to prevent slipping and regulate the distance of the gun from the target.

It is an additional object of the present invention to provide an improved underwater firearm which may be largely made of inexpensive durable materials including plastics.

SUMMARY OF THE INVENTION

An improved underwater firearm is provided which comprises a longitudinal hollow handle or tube with a cartridge receiving head at one end, a safety mechanism at the other end, and a trigger mechanism in between. The cartridge receiving head has a central through-bore of varying dimensions. A first larger bore near the external end of the head is for receiving the cartridge. A second smaller bore communicates between the larger bore and the interior of the hollow longitudinal handle. The firing pin passes through this smaller bore to contact the cartridge primer placed at the interior end of the larger bore. The firing pin is on the end of a longitudinal shaft which extends through the hollow handle and the safety mechanism and protrudes from the far end thereof. A pull grip is attached at the far end of the shaft for pulling the shaft and the firing pin away from the cartridge primer. The head is desirably of several pieces for easy loading of the cartridge and changing of the cartridge caliber. At least three pointed pins facing longitudinally outward on the exposed end of the head are desirably provided to give a non-slip means for engaging the target if that is desired.

A spring is mounted inside the hollow longitudinal handle; one end is fixed to the inside of the handle and the other end is fixed to the outside of the longitudinal shaft. When the shaft and firing pin are pulled back away from the cartridge primer the spring is compressed or stretched, depending upon its orientation, to store energy therein and provide a net restoring force directing the shaft and the firing pin toward the cartridge primer.

A trigger mechanism is provided part way along the elongated handle between the head and safety mechanism. The trigger mechanism includes a moveable lever which has an exterior part actuated by a finger or thumb and an interior part which extends through a slot in the handle into the interior tube to rest against the side of the shaft. The side of the shaft has a notch which engages a pawl on the trigger lever. This pawl retains the shaft in a cocked position against the spring force until the trigger is depressed. Depressing the trigger retracts the pawl and releases the shaft to drive the firing pin into the cartridge primer.

It is desirable that the part of the notch which engages the pawl and the face of the pawl which engages the notch be approximately tangential on engagement and be sloped toward the head end of the firearm. The engagement surfaces should be approximately tangential to a circle drawn with the trigger pivot as its center and whose plane lies in the plane of motion of the trigger lever.

The portion of the elongated shaft which passes through the safety mechanism has a transverse mounted safety pin which protrudes approximately at a right angle to the shaft and extends into the safety mechanism. The safety mechanism has a slot for receiving the safety pin. The pin and slot together restrict the motion of the shaft to certain longitudinal and rotational positions. A first part of the slot is longitudinally arranged and of a length which permits the safety pin and the shaft to travel forward until the firing pin strikes the cartridge primer and backward until at least the point where the trigger pawl engages the cocking notch on the shaft. A second part of the slot extends from the first part at an angle. To place the safety pin in the second part of the slot, the shaft (and hence the firing pin) must be pulled back away from contact with the cartridge primer and rotated. The second part of the slot does not allow the shaft to move forward sufficiently for the firing pin to contact the primer. This is the safe position. The portion of the slot between the safe position and the longitudinal part is desirably at a greater distance from the cartridge than the safe position so that the shaft must be pulled as well as rotated in order to return the safety pin to the longitudinal first part of the slot wherein firing is possible. The outer housing of the safety mechanism is desirable partly transparent or open to allow visual indication of the position of the safety pin.

DETAILED DESCRIPTION OF THE DRAWINGS

Figures 1, 2, 3, 4:
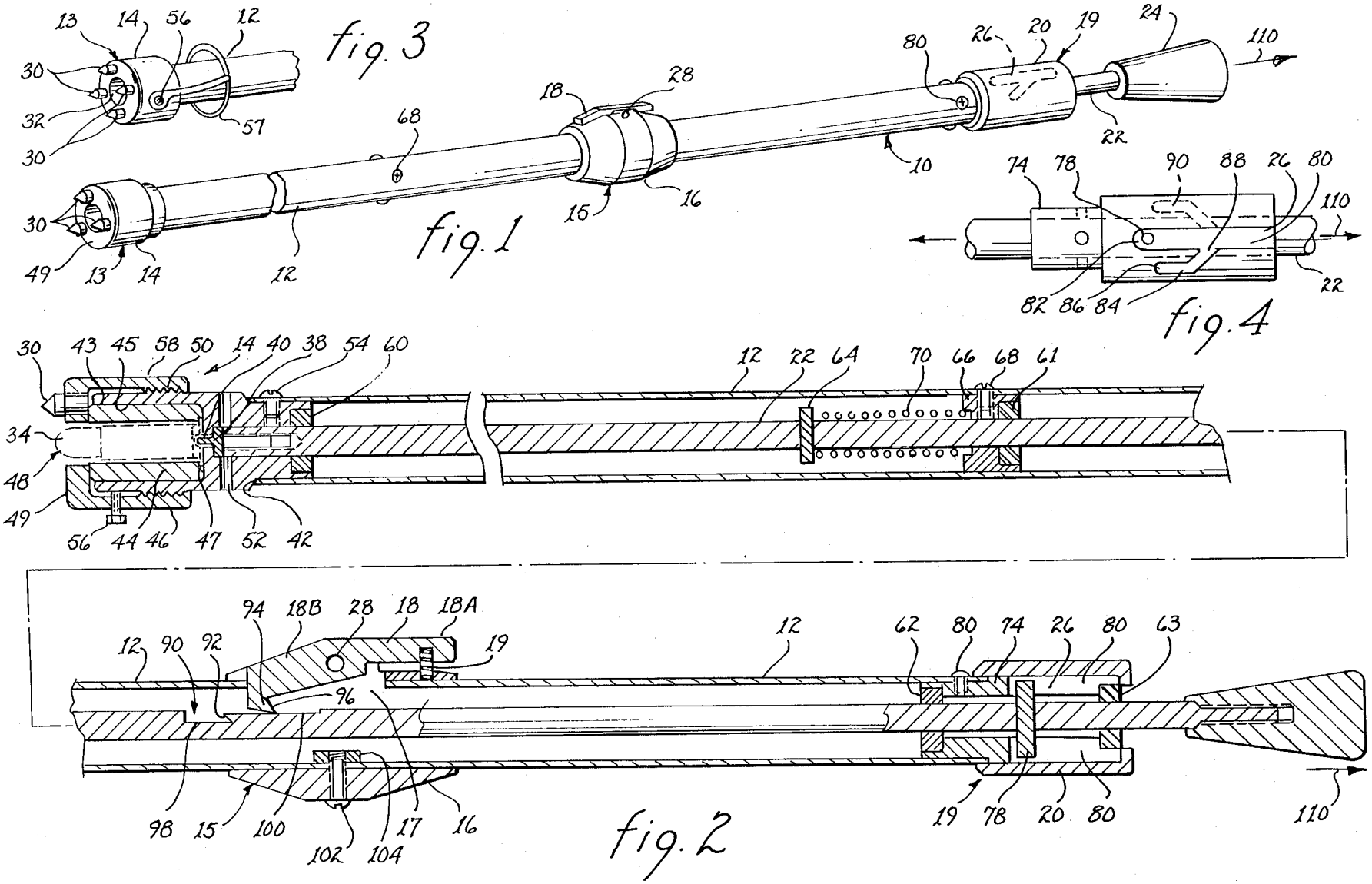
FIG. 1 is a simplified perspective view of the underwater firearm of the present invention according to a first embodiment.
FIG. 2 is a cross-sectional view of the underwater firearm of FIG. 1 showing interior construction details.
FIG. 3 is a simplified view of the head end of the underwater firearm of FIG. 1 according to another embodiment.
FIG. 4 is a simplified top view of the operative part of the safety mechanism portion of the underwater firearm of FIG. 1.

FIG. 1 is a simplified perspective view of underwater firearm 10 of the present invention and FIG. 2 is a simplified cross-sectional view thereof. The construction and operation of the underwater firearm are best understood by referring to both FIGS. 1 and 2 together, as well as the others figures to be subsequently described.

Underwater firearm 10 comprises hollow barrel or tube 12 which carries at one end cartridge receiving head means 13, at another end safety means 19, and intermediate therebetween, trigger means 15. Barrel or tube 12 serves as a handle for conveniently grasping underwater firearm 10. Inside barrel or tube 12 is located shaft means 22, preferably cylindrical in cross-section, and moveably supported by guides 60–63. The end of shaft 22 adjacent head means 13 carries firing pin 38 which, when shaft 22 is in its forward-most position (as shown in FIG. 2), extends through hole 40 to the contact primer or firing location of cartridge 34 which has been mounted in bore 48 of head means 13. Bore 48 is open at end or muzzle 49 of head means 13 to permit cartridge 34 to discharge into the target.

Firing pin 38 may be integral with shaft 22, that is, formed in one piece, or may be removable and attached thereto by any convenient means. It is desirable that firing pin 38 be removable so that it may be replaced if it breaks. It is also desirable that pin 38 be of a separate material than shaft 22 so that it may be specially hardened to withstand repeated impact against the primer.

It is desirable that head means 13 be made of several parts. Illustrated in FIG. 2 is a preferred arrangement in which head means 13 comprises head piece 42, insert 44, and cap 46. Head piece 42 is mounted on barrel or tube 12. Screws or rivets 54 are a convenient attachment means, but other means may also be used. It is desirable that head piece 42 extend inside or outside barrel or tube 12 so as to provide a strong and stable connection. The inside extending version shown in FIG. 2 is convenient. The extension of head piece 42 inside or outside tube 12 assists in maintaining alignment of head piece 42 and tube 12 so that shaft 22 and firing pin 38 may smoothly and freely move within guides 60–63 in barrel 12 and within through-hole 40 of head piece 42 without binding. Barrel 12 and head piece 42 could be of one piece construction, but this is less convenient. Head piece 42 has vents 52 communicating with through-bore 40 to allow water to escape from in front of advancing shaft 22 and firing pin 38 as they travel toward the primer during firing.

Sleeve 44 has outer surface 43, preferably cylindrical, which slides readily inside matching bore 45 of head piece 42. Sleeve 44 has interior bore 48 of a size to accept cartridge 34. Bore 48 is conveniently relieved at 47 to accept the rim of cartridge 34. Bore 48 is open toward end or muzzle 49 of head means 13. It is desirable that the length of sleeve 44 be greater than the length of bore 45 in head piece 42 so that when cap 46 is applied, it securely retains sleeve 44 within bore 45 of head piece 44 and presses the butt or primer end of cartridge 34 against head piece 42 at the interior end of bore 48 adjacent hole 40. Bore 48 and relief 47 in sleeve 44 may be of different sizes to accommodate different caliber cartridges and different cartridge designs. Thus, several difference sleeves, each adapted for a different caliber cartridge, may be used interchangeably in the same underwater firearm. This is a particular feature of the invented design.

Cap 46 is provided to retain sleeve 44 and cartridge 34 within head piece 42 so that the primer is in close proximity to through-hole 40 from which firing pin 38 protrudes when shaft 22 is in its forward-most position. This is the position illustrated in FIG. 2. Outer surface 58 of cap 46 is desirably knurled or roughened to provide a gripping surface for mounting and demounting cap 46. Cap 46 may attach to head piece 42 by any convenient means, such as for example, by screw threads or by a pin and groove bayonet type lock or by a spring catch. Since the explosion of cartridge 34 does not subject cap 46 to significant longitudinally directed force, great strength is not required in the means for coupling cap 46 to head piece 42. However, for good durability, a reasonable degree of robustness is desirable. Screw 56 and rotating loop 57 (see FIG. 3) are conveniently provided to retain cap 46 with barrel 12 when it is released from head piece 42 so that it does not become lost.

When it is desired to fire gun 10 in contact with a target, it is desirable to have some means for maintaining contact between the target and muzzle 49. This is particularly important with a gun adapted for use underwater where large sideways forces may be exerted on gun 10 by water currents or relative motion of the target and user. Also, underwater targets frequently have very slippery skin or outer coverings which make it difficult to keep the muzzle from sliding away from a vital spot at which it may initially be aimed. Accordingly, muzzle end 49 of head means 13 and cap 46 is provided with three or more pointed protrusions 30 extending generally in a longitudinal direction away from muzzle end 49 (see FIGS. 1–3). When firearm or gun 10 is jabbed against the target, points 30 engage the skin thereof to prevent slipping and assist in retaining firearm 10 in contact with the target while it is being discharged.

Firing of gun 10 is controlled by trigger means 15 (see FIGS. 1-2). Trigger means 15 comprises trigger mount 16 which is conveniently arranged on the outside of tube or handle 12 and attached thereto by attachment means 102, 104 or equivalent. Any convenient means for attaching mount 16 to tube 12 which does not interfere with shaft 22 or significantly weaken tube 12 will serve. Trigger mount 16 is aligned alongside slot or aperture 17 which penetrates through tube 12 in the vicinity of cocking notch 90 in shaft 22. Trigger mount 16 contains pivoting trigger arm or lever 18 rotatably supported on pivot pin 28. Trigger arm 18 has external portion 18A on one side of pivot pin 28 and internally extending portion 18B on the other side of pivot pin 28. Internally extending portion 18B contains pawl 94 with contact surface 96 for engaging contact surface 92 of cocking notch 90 in shaft 22. Spring 19 is conveniently used to maintain contact between trigger arm 18 and shaft 22. However, any convenient means for maintaining such contact will also serve.

In the forward-most position of shaft 22, that is, when firing pin 38 is able to contact the primer, pawl 94 of trigger arm 18 rests conveniently against flat or depressed region 100 on shaft 22. When shaft 22 is pulled back in the direction of arrow 110, i.e., in a direction to move firing pin 38 away from primer 36, then as notch 90 moves rightward in FIG. 2 past pawl 94, pawl 94 drops down toward bottom 98 of notch 90 so that when shaft 22 is returned toward its initial position, faces 92 and 96 engage, preventing firing pin 38 from contacting the primer 36 until pawl 94 is released from notch 90 by depressing trigger portion 18A toward handle 12.

It is desirable that face 92, as it extends upward from bottom 98 of notch 90, slope toward head means 13, and that face 96 of pawl 94 also incline in the same direction. The force of cocking spring 70 tends to hold pawl 94 in notch 90. Further, because of the direction of slope, shaft 22 must be forced back against cocking spring slightly before pawl 94 can release from notch 90. The amount of trigger pressure required to release pawl 94 and fire the gun may therefore be adjusted both by adjusting the force of spring 19 but also by varying the angle of slope of faces 92 and 96. This allows a crisp and safer trigger action to be obtained. In the preferred embodiment, faces 92 and 96 are approximately tangent when engaged. It is convenient to have faces 92 and 96 approximately tangent to a circle drawn using the center of rotation of trigger arm 18, e.g., pin 28, as its center and whose plane is parallel to the plane of rotation of trigger arm 18.

Spring 70 is provided interior to tube 12 with a first end maintained in contact with shaft 22 by means 64 (e.g., a pin or fixed washer) and a second end maintained in contact with tube 12 by means 66 (e.g., a cylindrically shaped bushing held inside tube 12 by attachment 68). Any reasonable means for connecting spring 70 to shaft 22 and tube 12 may be used. In the arrangement shown in FIG. 2, where spring retaining means 64 is mounted ahead of spring retaining means 66, i.e., closer to head means 13, spring 70 is compressed when shaft 22 is moved in direction 110 to cock firearm or gun 10. However, by locating spring retaining means 64 behind spring retaining means 66, i.e., closer to safety means 19, spring 70 is tensioned when shaft 22 is moved in direction 110. Either arrangement is useful.

Safety means 19 surrounding shaft 22 is provided for placing gun 10 in a safe condition. Shaft 22 has extension means 78 mounted therein which extends substantially perpendicular to shaft 22. A pin is convenient for this purpose but other integral or separate protrusions will also serve. Pin 78 extends outwardly into slot 26 in safety guide 74. Slot 26 and pin 78 acting together restrict the motion of shaft 22 to certain longitudinal and rotational positions. This is most clearly seen in FIGS. 1, 2, and 4. Safety guide 74 conveniently extends into (or over) tube 12 to provide a strong stable connection. Attachment means 80 hold guide 74 in place in tube 12. Screws or rivets are convenient attachment means. Guide bushings 62-62 may be integral with safety guide 74 or separate parts. It is important that shaft 22 move through bushings 62-63 and guide 74 without binding. Pin 78 may extend outwardly from both sides of shaft 22, as shown for example in FIG. 2, or from only one side. A one-sided pin and slot arrangement will work. However, having safety pin 74 extend from both sides of shaft 22 into corresponding diametrically opposed slots 26 is preferred since it provides redundancy. The safety mechanism will still function even if part of pin 78 breaks away. It is desirable that outer shell 20 surrounding safety guide 74 of safety means 19 be transparent or have transparent or open regions so that the position of safety pin 78 in slot 26 may be determined by inspection.

In order for shaft 22 to move forward so that firing pin 38 can engage the primer, safety pin 78 must be in longitudinal portion 80 of slot 26. Only portion 80 extends sufficiently in the longitudinal direction, i.e., to position 82 (see FIG. 4), to permit firing pin 38 to strike the primer and fire cartridge 34. Safety pin 78 should be in slot portion 80 for pawl 94 to engage cocking notch 90.

Slot 26 has second portion 84 located at an angle with respect to first slot portion 80. In order to place safety pin 78 into portion 84, shaft 22 must be both pulled and rotated from its position in contact with the primer. This is most clearly seen in FIG. 4. When shaft 22 is both pulled and rotated counter clockwise (as viewed from grip 72) safety pin 78 may be placed into second slot portion 84 so that safety pin 78 rests in location 86. Then gun 10 is on "safe". This is because position 86 is further from head means 13 than position 82 and restrains shaft 22 so that firing pin 38 cannot reach the primer. While FIGS. 1 and 4 illustrate the situation where slot 26 is arranged so that "safe" requires a counter clockwise rotation of shaft 22, those of skill in the art will understand that portion 84 of slot 76 could equally well be arranged for clockwise rotation. Either position will serve.

While slot portion 84 may make any angle with respect to slot portion 80 which insures that safety pin 78 will remain in position 86 against the returning force of cocking spring 70, certain arrangements are more desirable. For example, it is desirable that slot portion 84, including position 86, make an acute angle with respect to slot portion 80 as shown in FIGS. 1 and 4. This insures that shaft 22 must be pulled in direction 110 as well as rotated in order to release shaft 22 from safe position 86. Alternatively, the same result is obtained by having any part 88 of slot portion 84 located between slot portion 80 and position 86 be at a greater distance from head means 13 than position 86.

Underwater firearm 10 is desirably operated by loading cartridge 34 into head means 13, pulling back shaft 22 by means of grip 72 against spring 70 with safety pin 78 in slot portion 80 to engage trigger pawl 94 in cocking notch 90; or pulling back and rotating shaft 22 in a first direction to place safety pin 78 in safe position 86, and then pulling back and rotating shaft 22 in the opposite direction to return safety pin 78, to firing slot 80 and engage trigger pawl 94 and notch 90; and then depress trigger portion 18A toward tube 12 to release trigger pawl 94 from notch 90, thereby allowing shaft 22 carrying firing pin 38 to move forward in response to the energy stored in spring 70 so that firing pin 38 strikes the primer, firing cartridge 34.

It is desirable that underwater firearm 10 be made of durable and corrosion resistant material. Tube 12, shaft 22, pins 30, 38, 64, and 78, head parts 42 and 44, trigger pawl 94 and safety guide 74 be of metal. Parts such as cap retainer 57, shell 20 and grip 72 are conveniently of plastic. Other parts such as cap 46, trigger mount 16, trigger 18 and bushings 60-63 may be of either plastic or metal or a combination thereof.

From the foregoing, those of skill in the art will understand the nature and construction of all forms of the invention and the manner in which the objects and and advantages set forth herein are realized. The foregoing disclosure is intended to be representative of preferred exemplary forms of the invention and is to be interpreted in an illustrative rather than a limiting sense. It is intended that the invention to be accorded the full scope of the claims appended hereto.

I claim:

1. An underwater firearm comprising:

an elongated handle having first and second opposed ends and a hollow interior, and having an intermediate portion between said ends, wherein said intermediate portion has therein a trigger aperture extending into said hollow interior for receiving a trigger means;

a first spring retaining means fixed in said hollow interior of said handle between said first and second ends thereof for retaining a first end of a spring means;

head means attached to said first end of said hollow handle for receiving in a first interior location a cartridge having an explosive primer oriented so that said primer faces toward said hollow handle, wherein said head means has a first hole extending in a first direction between said first interior location and said hollow interior of said handle for admitting a firing pin for exploding said primer, and wherein said head means has a second hole extending from said interior location in a second direction opposite said first direction to an exterior end of said head means to permit the exploding charge of said cartridge to escape from said exterior end on firing;

an elongated firing rod lengthwise aligned in said hollow handle and having, adjacent said first end of said handle, a first end containing a firing pin adapted to extend through said first hole in said head means for exploding said primer, and having a second end extending beyond said second end of said handle, and having an intermediate portion containing a cocking latch means for retaining said firing rod in a cocked position wherein said firing pin is spaced away from said primer;

second spring retaining means fixed to said firing rod between said first and second ends thereof for retaining a second end of said spring mean;

spring means extending between said first and second spring retaining means for forcing said firing pin against said primer;

guiding means for moveably holding said firing rod in said hollow handle;

trigger support means on said hollow handle and extending alongside said trigger aperture;

moveable trigger means pivotally supported by said trigger support means and extending through said trigger aperture into said hollow interior interior of said handle for engaging said cocking latch means on said firing rod to hold said firing rod in a cocked position against the force of said spring means;

safety pin means extending substantially perpendicular to said firing rod and attached thereto near said second end of said hollow handle;

safety latch means located at said second end of said handle, surrounding said firing rod passing longitudinally therethrough, and longitudinally encompassing said safety pin means, wherein said safety latch means comprises a slot for receiving said safety pin means, and wherein said slot has a first part that is longitudinally aligned parallel to said firing rod and a second part communicating with said first part but circumferentially displaced therefrom and a third part intermediate between said first and second parts, and wherein said third part is at a greater distance from said first end of said handle than the portion of said first and second parts closest thereto, and wherein said closest portions of said first and second parts are at a distance from said first end of said handle such that when said safety pin means is located in said first part said firing pin may contact said primer, and when said safety pin means is located in said second part, said firing pin may not contact said primer; and gripping means on said second end of said firing rod for pulling said firing rod and pin longitudinally away from said primer and compressing said spring means.

2. The underwater firearm of claim 1 further comprising on said head means at least three target engagement protrusions located on said exterior end of said head means, facing away therefrom in a longitudinal direction, and spaced substantially evenly around a circle concentric with said third interior through-bore.

3. The underwater firearm of claim 1 further comprising vent means extending in a generally transverse direction through said head means and communicating with said first hole therein.

4. The underwater firearm of claim 1 wherein said safety latch means comprises a transparent portion above said slot for providing a visual indication of the position of said safety pin means.

5. The underwater firearm of claim 1 wherein said head means comprises:

a head part, a sleeve part, and a cap part; and wherein said head part contains said first interior location and wherein said head part attaches to said handle by a first end, and wherein said head part has a second end opposite said first end and a first exterior surface extending therebetween, and wherein said head part has a first interior bore extending from said second end of said head part a first predetermined distance to said first interior location, and wherein said head part contains said first hole extending from said first interior location to said first end of said head part; and wherein said sleeve part has a first end and a second end and a second exterior surface extending therebetween and a second predetermined length therebetween, and wherein said second exterior surface of said sleeve part removably engages said first interior bore of said head part, and wherein said sleeve part has second hole comprising a second interior through-bore for receiving said cartridge at said first end of said sleeve part, and wherein said second predetermined length is such that when said sleeve part containing a cartridge is placed in said head part with said cartridge primer adjacent said first interior location, said second end of said sleeve part protrudes from said second end of said head part; and wherein said cap part has a first end and a second end and a third exterior surface extending therebetween and a third interior through-bore extending therebetween, and wherein said third interior through-bore has a first region communicating with said first end of said cap part which removably engages said first exterior surface of said head part and a second region communication with said second end of said cap part which removably engages said second end of said sleeve part to retain said sleeve part in said head part.

6. The underwater firearm of claim 5 wherein said first end of said sleeve part is relieved adjacent said second interior through-bore for accommodation a rim of said cartridge.

7. The underwater firearm of claim 5 further comprising at least three pointed protrusions outward facing on said second end of said cap part and substantially evenly spaced around said second end of said cap part external to said third interior through-bore.

8. The underwater firearm of claim 1 wherein said cocking latch means comprises a notched region on said firing rod, and wherein said notched region has an open top portion, a bottom portion, and first and second end portions extending from said bottom portion to said open top portion and arranged substantially transversely to said firing rod and labelled in the same sense as said first and second ends of said firing rod, and wherein said second end portion of said notched region slopes toward said first end of said firing rod.

9. The underwater firearm of claim 8 wherein said trigger support means has a trigger pivot located outside said hollow handle for pivotally supporting said trigger means.

10. The underwater firearm of claim 8 wherein said trigger support means comprises a transversely arranged pivot pin about which said trigger means rotates and wherein said trigger means has a first part located outside said hollow handle and on one side of said pivot pin and a second part located inside said hollow handle and on another side of said pivot pin.

11. The underwater firearm of claim 8 wherein said trigger means has a distal end for engaging said cocking latch and wherein said distal end has a protrusion having a face oriented for engaging said second end portion of said notched region, and wherein said face is sloped to make substantially tangential contact with said second end portion when engaged therewith.

12. The underwater firearm of claim 8 wherein said trigger support means has a pivot means for pivotally mounting said trigger means thereto, and wherein said trigger means has a distal end located within said hollow handle for engaging said cocking latch and wherein said distal end has an engagement face for contacting said second end portion of said notched region when engaged therewith, and wherein said second end portion of said notched region is sloped at an angle which conforms substantially to a tangent to a circle drawn through said second end portion when engaged by said engagement face and with said pivot means as the origin of said circle.

13. The underwater firearm of claim 12 wherein said pivot means comprises a pivot pin passing through said trigger means and transversely oriented with respect to said handle.

14. An underwater firearm comprising:

a cartridge holding means for containing an explosive cartridge having a firing location;

a support tube attached by a proximate end to a first end of said cartridge holding means and having at a distal end a safety latch means;

a moveable shaft extending longitudinally through said support tube and having a firing pin mounted on a proximate end thereof adjacent said proximate end of said support tube for extending into said cartridge holding means for contacting said firing location on said cartridge, and having a distal end extending beyond said safety latch means and terminating in a cocking grip, wherein said moveable shaft has at a central region thereof a catch means for retaining said shaft in a cocked position with respect to said cartridge;

trigger means mounted on said support tube proximate said central region of said moveable shaft and having a moveable latch pawl extending into said support tube for engaging said catch means on said moveable shaft when cocked and having a moveable trigger arm coupled to said latch pawl and extending outside said support tube for releasing said latch pawl from said catch means when said trigger arm is displaced toward said support tube; and safety pin means mounted on said moveable shaft for engaging said safety latch means when said cocking grip is longitudinally pulled and rotated.

15. The underwater firearm of claim 14 wherein said safety pin means comprises a safety pin fixed to said shaft and extending substantially transversely thereto and wherein said safety latch means comprises a slot for slideably receiving said safety pin, wherein said slot has a first longitudinally arranged part permitting said shaft to be longitudinally pulled without rotation away from a first position wherein said firing pin is in contact with said firing location to a second position wherein said firing pin is spaced apart from said firing location but free to return thereto, and wherein said slot has a second part communicating with said first part and at an angle thereto into which said safety pin may be placed by pulling and rotating said shaft from its first position into a third position wherein said shaft is spaced apart from said first position and not free to return thereto, being held away from said first position by said safety pin bearing against said second part of said slot.

16. The underwater firearm of claim 15 wherein said second part of said slot has a first longitudinal distance from said firing location and wherein said slot further comprises a third part intermediate said first and second parts and having a second longitudinal distance from said firing location greater than said first longitudinal distance so that in order to move said safety pin from said second part to said first part of said slot, said shaft must be pulled and rotated.

17. The underwater firearm of claim 15 wherein said second part of said slot makes an angle less than ninety degrees with respect to said first part of said slot in a direction toward said cartridge and has a length less than said first part.

18. The underwater firearm of claim 15 wherein said first and second parts of said slot communicate via a third part of said slot and wherein said third part of said slot has a sidewall toward said firing position whose distance from said firing location varies as a function of distance away from said first part of said slot, and wherein a portion of said sidewall toward said firing position and closer to said first part is further from said firing position than another portion of said sidewall further from said first part.

19. The underwater firearm of claim 14 further comprising a longitudinally actuated spring means extending along a portion of the length of said shaft inside said tube and fixed at a first end to said shaft and at a second end to said tube so that when said shaft is pulled away from said firing location on said cartridge, energy is stored in said spring.

20. A method for firing an underwater firearm comprising:

providing an underwater firearm having a longitudinal cocking shaft bearing a firing pin at one end and a cocking grip at the other end and moveably restrained within a tube by a spring and guide means, wherein said tube has attached at one end a head piece containing a cartridge receptacle adjacent said firing pin and an open end opposite said firing pin for releasing the contents of said cartridge, and wherein said tube has at another end a safety latch means through which said shaft passes and which has first and second communicating slots for, respectively, engaging a safety pin attached to said shaft to prevent longitudinal motion of said shaft to contact said cartridge in a first rotational shaft position and permit longitudinal motion of said shaft for discharging said cartridge in a second rotational shaft position, and wherein said shaft has a cocking notch therein located between said firing pin and said safety pin for receiving a releasable trigger pawl adapted to moveably contact said shaft and wherein said trigger pawl having a trigger arm coupled thereto is pivotally attached to said tube to engage said cocking notch when said shaft is moved underneath said pawl for cocking and retract from said cocking notch when released for firing by actuation from outside said tube;

inserting a cartridge having a precussion primer into said head piece with said precussion primer facing said firing pin;

gripping said tube by a first means and with a second means pulling longitudinally on said grip to move said firing pin away from said primer and store energy in said spring, then rotating said grip to place said safety pin in said first rotational position to prevent firing; then with said trigger pawl in contact with said shaft, pulling and rotating said grip and shaft to remove said safety pin from said first rotational position and into said second rotational position and moving said grip and shaft toward said head piece until said pawl engages said cocking notch to cock said firearm; and then when said tube is pointed at a target, said trigger arm is displaced toward said tube thereby actuating said trigger pawl to retract it from said cocking notch, releasing said shaft to drive said firing pin against said primer, thereby firing said cartridge in the direction of an underwater target.

* * * * *